US011364649B2

(12) United States Patent
Hagel

(10) Patent No.: US 11,364,649 B2
(45) Date of Patent: Jun. 21, 2022

(54) DRIVE DEVICE, APPARATUS FOR NOTCHING, AND METHOD FOR DRIVING APPARATUS FOR NOTCHING

(71) Applicant: HSF AUTOMATION GMBH, Grünkraut-Gullen (DE)

(72) Inventor: Martin Hagel, Baienfurt (DE)

(73) Assignee: HSF AUTOMATION GMBH, Grunkraut-Gullen (DE)

( * ) Notice: Subject to any disclaimer, the term of this patent is extended or adjusted under 35 U.S.C. 154(b) by 0 days.

(21) Appl. No.: 16/757,252

(22) PCT Filed: Oct. 17, 2018

(86) PCT No.: PCT/EP2018/078341
§ 371 (c)(1),
(2) Date: Apr. 17, 2020

(87) PCT Pub. No.: WO2019/076950
PCT Pub. Date: Apr. 25, 2019

(65) Prior Publication Data

US 2020/0338775 A1 Oct. 29, 2020

(30) Foreign Application Priority Data

Oct. 18, 2017 (DE) ..... 10 2017 124 335.6

(51) Int. Cl.
*B26D 3/14* (2006.01)

(52) U.S. Cl.
CPC ..... *B26D 3/14* (2013.01)

(58) Field of Classification Search
CPC ..... B21D 28/22; B26D 3/14; B30B 15/26; B30B 1/266
See application file for complete search history.

(56) References Cited

U.S. PATENT DOCUMENTS 5,911,806 A 6/1999 Bareis et al.
7,427,258 B2 9/2008 Schmauder
8,302,452 B2 * 11/2012 Golorans ..... B30B 15/146 72/443

(Continued)

FOREIGN PATENT DOCUMENTS

CN 203184395 9/2013
CN 205519169 8/2016

(Continued)

OTHER PUBLICATIONS

International Search Report for PCT/EP2018/078341, dated Feb. 26, 2019.

(Continued)

*Primary Examiner* — Stephen Choi
(74) *Attorney, Agent, or Firm* — James R. Hayne; Stites & Harbison PLLC

(57) ABSTRACT

The present invention relates to a drive device for driving an apparatus (100) for notching, wherein the apparatus (100) for notching comprises a frame with a stand (104) and a headpiece (106), a plunger (114) coupled to the headpiece (106) and movable along a punching axis (116) oriented along a y axis, and optionally an indexing head (120) for receiving a workpiece (102) to be machined. The drive device comprises an electrical direct drive (118) for driving the plunger (114).

9 Claims, 7 Drawing Sheets

(56) References Cited

U.S. PATENT DOCUMENTS

Figure 1:
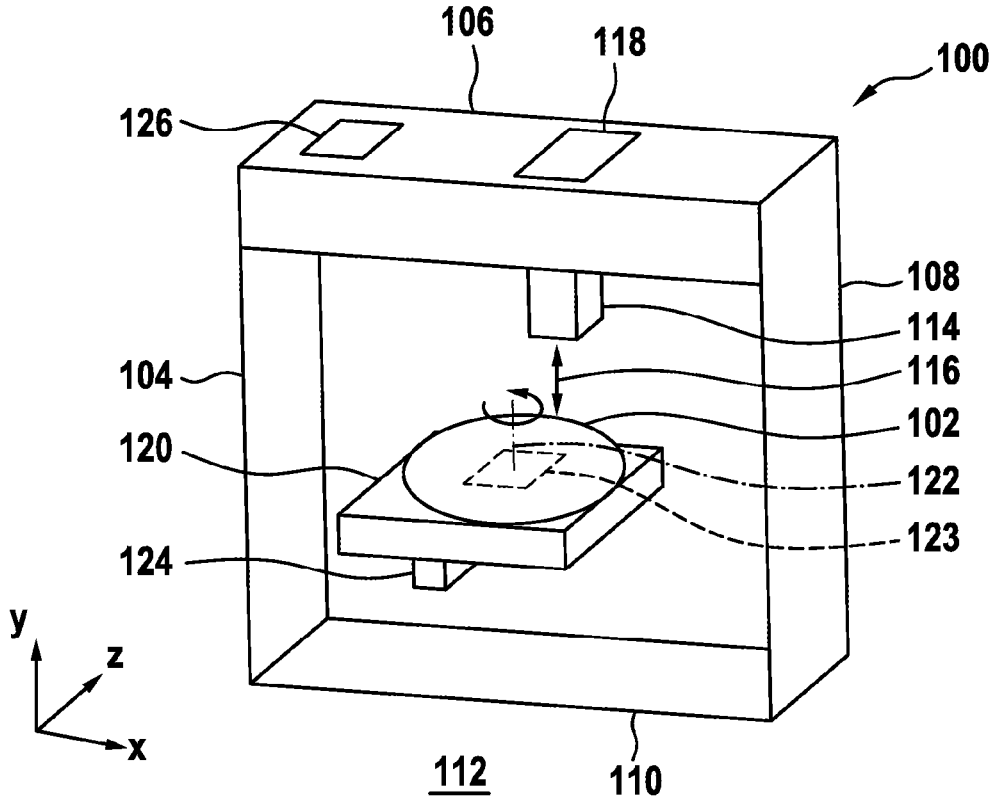

| | | | | |
|---|---|---|---|---|
| 9,452,581 | B2 | 9/2016 | Martin et al. | |
| 9,701,084 | B2 * | 7/2017 | Martin | B30B 1/06 |
| 9,724,889 | B2 | 8/2017 | Martin et al. | |
| 2009/0007622 | A1 | 1/2009 | Segura Golorons et al. | |
| 2010/0320856 | A1 * | 12/2010 | Lauke | B21J 9/18 310/80 |
| 2016/0016372 | A1 | 1/2016 | Martin et al. | |
| 2016/0016373 | A1 | 1/2016 | Martin et al. | |
| 2016/0031176 | A1 | 2/2016 | Martin et al. | |
| 2017/0305094 | A1 * | 10/2017 | Kosse | B30B 1/14 |

FOREIGN PATENT DOCUMENTS

| | | |
|---|---|---|
| DE | 891833 | 10/1953 |
| DE | 2911820 | 10/1980 |
| DE | 20301895 | 6/2004 |
| FR | 1420534 | 12/1965 |
| JP | S57204829 | 12/1982 |
| JP | 2016022536 | 2/2016 |

OTHER PUBLICATIONS

Written Opinion of the International Searching Authority for PCT/EP2018/078341, dated Feb. 26, 2019.
German Office Action for DE 102017124335.6, dated Feb. 21, 2019.
Chinese Office Action for related application CN 201880067811.X dated Sep. 22, 2021.
Chinese Office Action for related application CN 201880067811.X dated Apr. 4, 2021.

* cited by examiner

DRIVE DEVICE, APPARATUS FOR NOTCHING, AND METHOD FOR DRIVING APPARATUS FOR NOTCHING

The present invention relates to a drive device, an apparatus for notching, and to a method for driving apparatus for notching.

Notching presses are employed for producing rotor and stator sheets for electric motors and generators, for example. In small-batch series or due to large sheet diameters, production in a compound die is not profitable owing to the costs. Therefore, the sheets are produced in several punching processes with a single notching punch, the so-called single notching.

Notching presses are configured as C frame punch presses. The punch presses have an electrical speed-regulated main drive driving a flywheel and transmitting the force to the mechanical drive components and eventually the plunger via a coupling/brake combination. The backwardly protruding section of the C frame of these machines is used for accommodating the main drive and the further drive elements for force transmission.

DE 195 37 475 A1 discloses a notching press having a C frame.

It is the object of the present invention to provide an improved drive device, an improved apparatus for notching, and an improved method for driving an apparatus for notching.

This object is achieved by a drive device, an apparatus for notching, and a method for driving an apparatus for notching according to the main claims.

Advantageously, the main drive of an apparatus for notching can be realized as a direct drive. Such a device may comprise a frame with a stand and a headpiece as well as a plunger coupled to the headpiece and movable along a punching axis extending along a y axis as well as optionally also an indexing head for accommodating a workpiece to be machined. The indexing head may be coupled to the frame. Furthermore, the indexing head may be configured to accommodate the workpiece so as to be rotatable about an indexing head axis extending along the y axis. An electrical direct drive is provided for driving the plunger.

The apparatus for notching is also referred to as a notching press, punch press or machine. The drive device may serve as a replacement for known drives of notching presses. The apparatus may be employed for producing stator and rotor sheets for electric machines, for example. The frame may be realized as a so-called C frame or as an O frame, in this case with a further stand. Driven by the drive device, the plunger may be moved linearly back and forth along the punching axis. The frame may be realized integrally as a so-called mono block or as multiple parts. An end of the plunger facing away from the headpiece may comprise or accommodate a tool for punching a notch into a workpiece. The indexing head may be connected to the frame or to the ground in the assembled state of the apparatus. The indexing head may be a device as already employed in known notching presses. The indexing head may include means for holding and for rotating the workpiece about the indexing head axis.

Advantageously, both a punching stroke necessary for a punching process and an upstroke of the plunger necessary for replacement of the workpiece may be performed using the direct drive. Moreover, a pendular stroke allowing for high flexibility the control of the motion of the plunger may be realized.

The direct drive may comprise an electric machine, a drive shaft drivable by the electric machine and comprising eccentric, and a connecting rod coupled to the eccentric and coupleable to the plunger. The drive shaft may be rigidly connected to a rotor of the electric machine. In this way, the driving motion may be transmitted in a very direct manner to the plunger. Moreover, such a direct drive requires only very little constructive space and may thus be integrated directly to the headpiece, for example.

The drive device may include a housing which at least an electric machine of the electrical direct drive is arranged. The housing may comprise a mechanical interface for fixing the housing to the headpiece. Such an interface may be realized by a shape of the housing adapted to an accommodation of the headpiece or by a fixing element formed on the housing, for example.

The drive device may comprise a controller. The controller may be configured to provide an electric control signal for effecting rotation of a drive shaft of the direct drive. Linear motion of the plunger may be effected by the rotation of the drive shaft. The controller may be realized as a control unit including an electric circuit and having suitable interfaces for receiving and outputting electric signals. The controller may be realized in a programmable way so that a motion profile of the plunger may easily be adapted to a workpiece to be machined.

An apparatus for notching comprises:

a frame with a stand and a headpiece connected to the stand;

a plunger coupled to the headpiece and movable along a punching axis oriented along a y axis;

optionally an indexing head for accommodating the workpiece to be machined, wherein the indexing head is coupled to the frame and configured to rotate the workpiece about an indexing head axis oriented along the y axis; and a drive device as mentioned for driving the plunger.

The frame may comprise a second stand offset from the stand along an x axis. Herein, the headpiece may be arranged between the stands and may connect a free end of the stand to a free end of the second stand, for example. The indexing head axis and the punching axis may be offset from each other along a z axis. An O frame may be realized by way of the second stand. Thereby, the direct drive may be utilized better than with a C frame.

Advantageously, at least an electric machine of the electrical direct drive may be arranged on the headpiece. In this way, the electric machine may be arranged very closely to the plunger.

A method for driving an apparatus for notching as mentioned comprises the step of:

rotating a drive shaft of the direct drive to effect linear motion of the plunger.

Due to the direct drive, rotation of the drive shaft is not limited to a complete revolution. Instead, the drive shaft may also be rotated by a portion of a full revolution and may then be rotated back. Also, rotational speed of the drive shaft may be varied, for example also within a single revolution.

The step of rotating may include a step of rotating forward, in which the drive shaft is rotated by a first portion of a full revolution in a first rotational direction, and a step of rotating backward, in which the drive shaft is rotated by the first portion in a second rotational direction opposite to the first rotational direction. The first portion may correspond to a first rotation angle about which the drive shaft is rotated. Here, the first rotation angle may be smaller than 360°. Pendular operation of the plunger may be realized by rotating the drive shaft in different rotational directions.

For example, in the step of rotating forward, the drive shaft may be rotated to move the plunger from a top reversal point via a lowest reversal point back to the top reversal point. In the step of rotating backward, the drive shaft may be rotated backward to move the plunger from the top reversal point via the lowest reversal point back to the top reversal point. Thus, both in the step of rotating forward and in the step of rotating backward, the plunger may perform a downward motion and upward motion each. Thus, when rotating forward and when rotating backward, a punching stroke for punching a notch each may be performed.

A bottom or lowest reversal point may be a position of the plunger in which a tool of the apparatus has pierced the workpiece, and thus a notch has been punched.

Additionally or alternatively, the step of rotating may include a step of rotating forward, in which the drive shaft is rotated about a second portion of a full revolution in the first rotational direction, and a step of rotating backward, in which the drive shaft is rotated about the second portion in the second rotational direction. The second portion may differ from the first portion. For example, the second portion may correspond to a second rotation angle differing from the first rotation angle in terms of magnitude and/or with reference to the position in the full circle. For example, when rotating forward, the drive shaft may be rotated to move the plunger from a top reversal point to a bottom reversal point. When rotating backward, the drive shaft may be rotated back to move the plunger from the bottom reversal point to the top reversal point. Thus, the plunger may be moved downward when rotating forward and upward again when rotating backward, for example, thus realizing a punching stroke.

In the step of rotating, the rotating shaft may be rotated to a predetermined rest position from a current position, in order to effect an upstroke of the plunger. For example, the plunger may be at a top dead center when the drive shaft is in the rest position. Thus, upstroke and punching stroke may be realized using the same drive.

Advantageously, in the step of rotating, rotational speed of the drive shaft may be set depending on a course of a rotation of the workpiece about the indexing head axis. In this way, time intervals for performing rotation about the indexing head axis and for performing a punching motion of the plunger may be adapted to each other. Also, impact velocity of the tool onto the workpiece may be optimized.

In the step of rotating, the drive shaft may be rotated at a first rotational speed in a first time interval and at a second rotational speed different from the first rotational speed in a second time interval. Thus, the drive shaft may rotate at different rotational speeds while performing a single punching stroke, for example. Thereby, the timing of a punching process may be controlled in a very flexible way.

What is also advantageous is a computer program product with program code which may be stored on a machine-readable carrier, such as semiconductor storage, hard-disk storage or optical storage, and is used for performing the method according to one of the previously described embodiments, when the program product is executed on a computer or a device. Corresponding program code may be implemented by the controller mentioned, for example.

Figure 2:
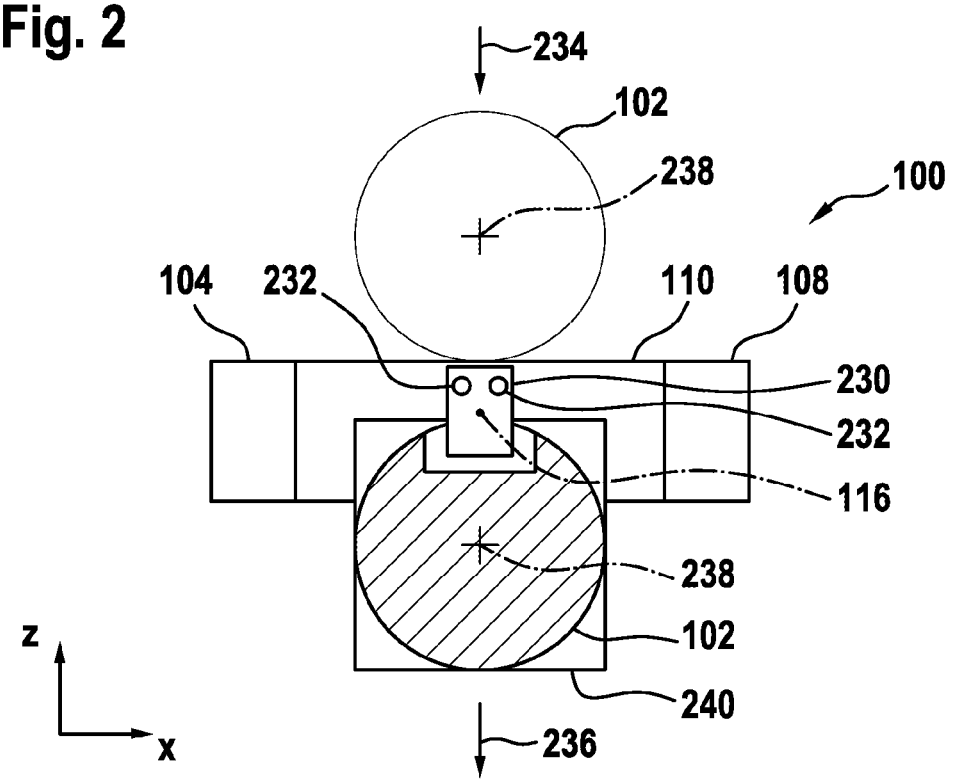
Figure 3:
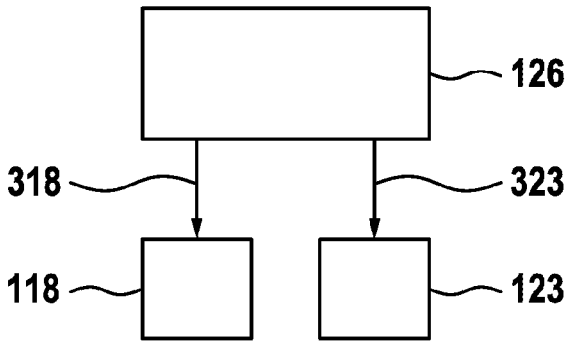
Figure 4:
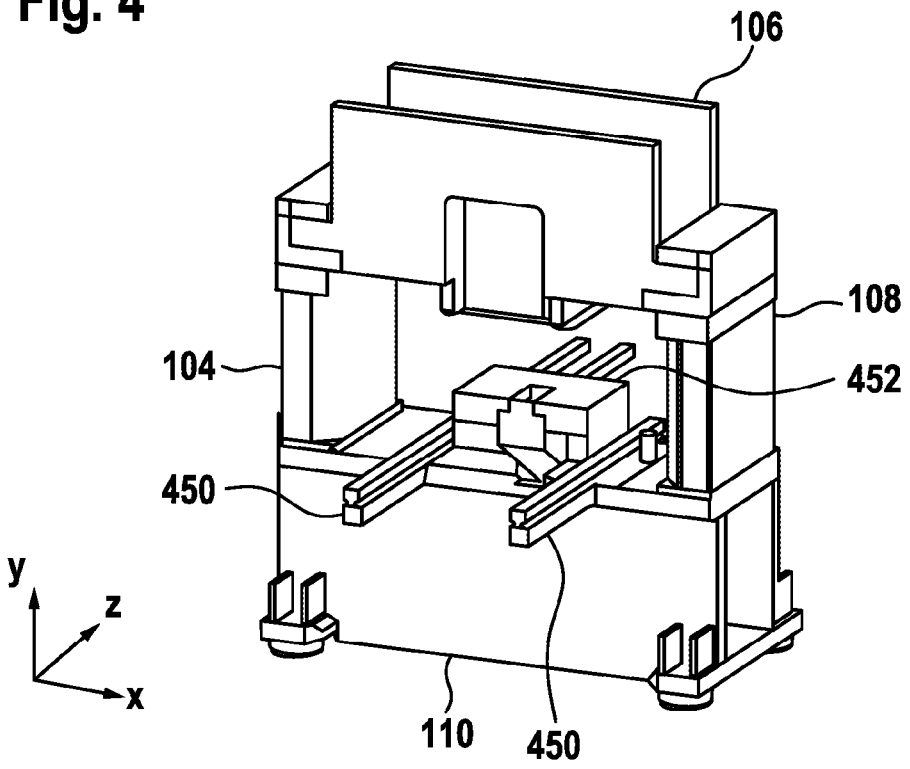
Figure 5:
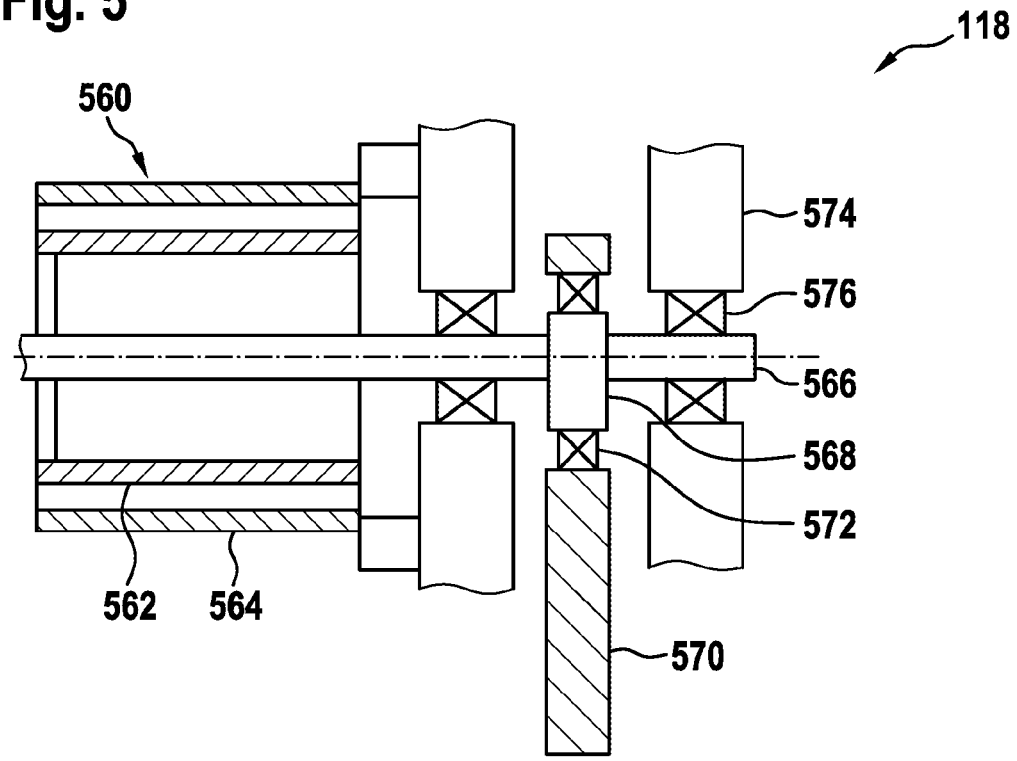
Figure 6:
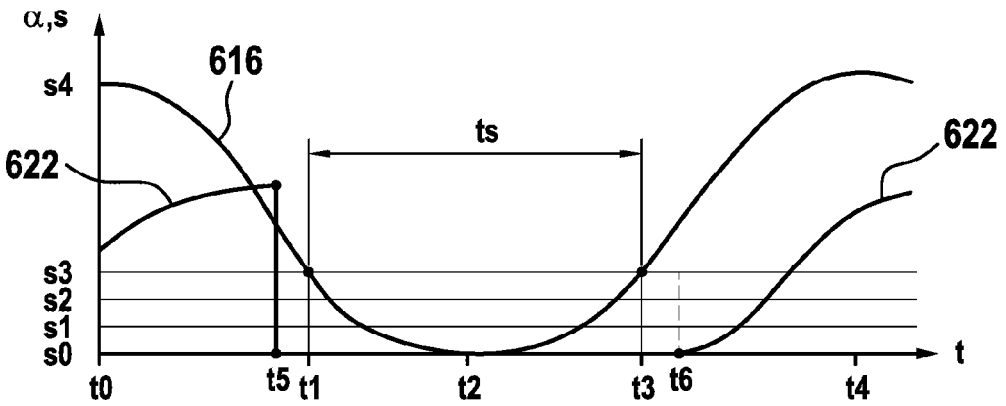
Figure 7:
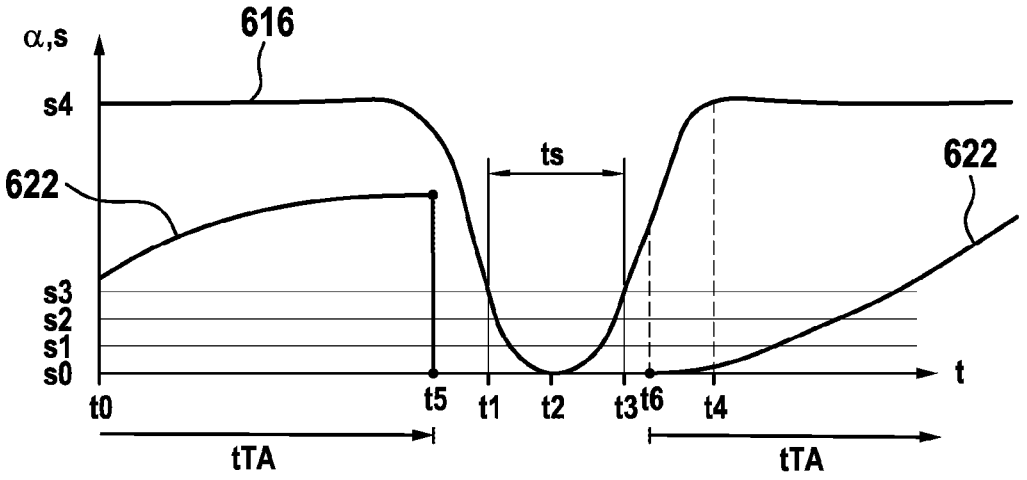
Figure 8:
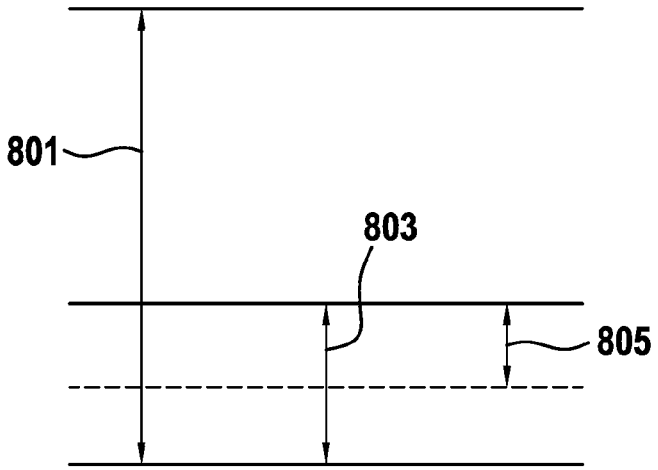
Figure 9:
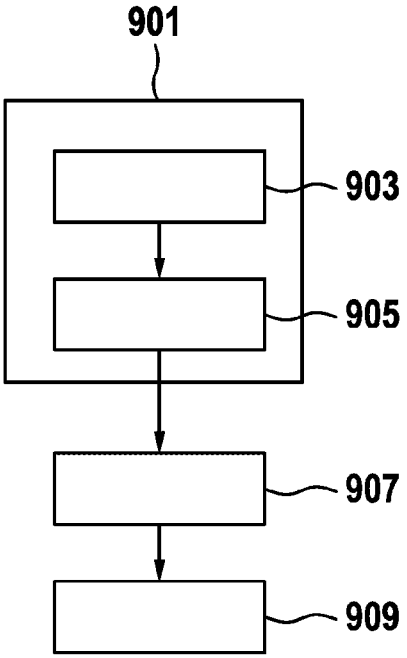
Figure 10:
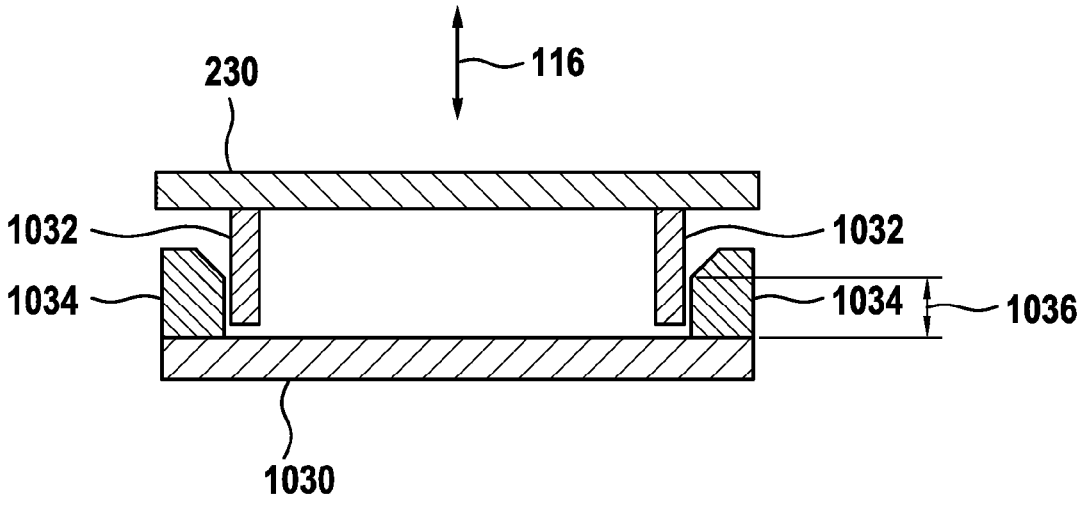
Figure 11:
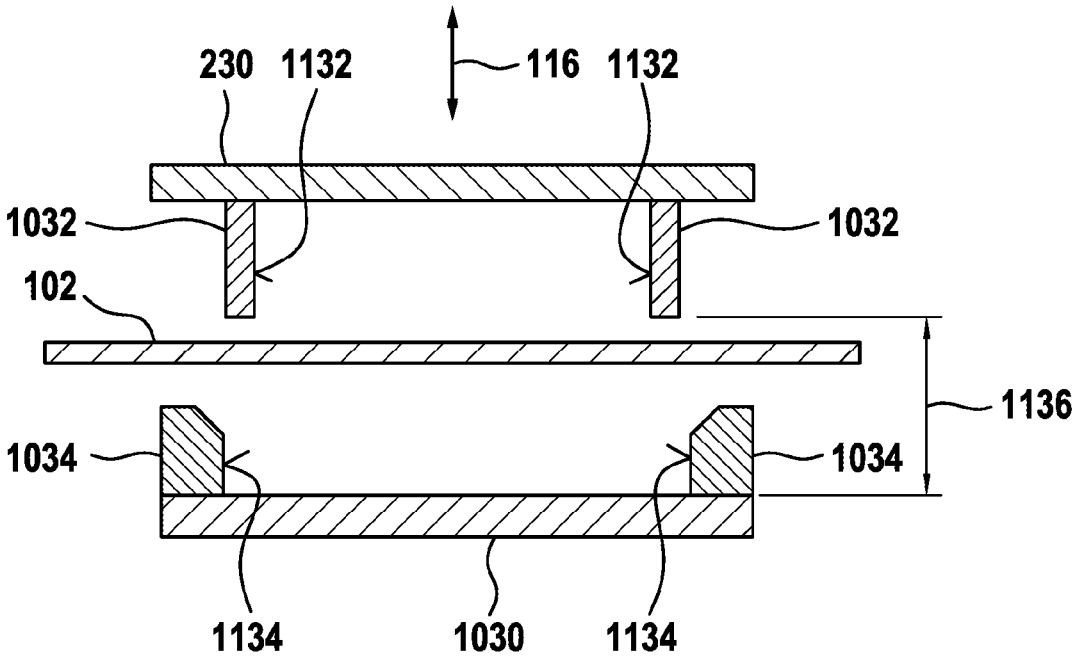
Figure 12:
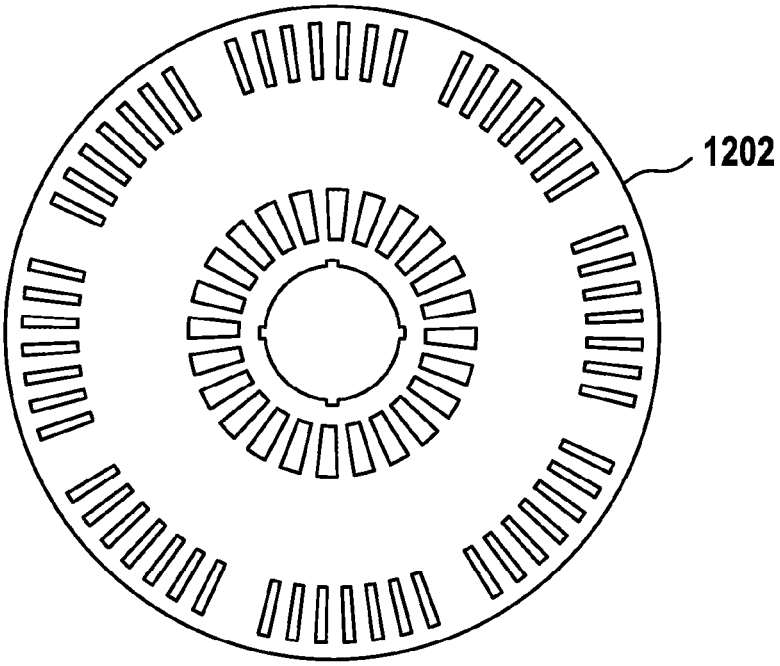

Preferred embodiments of the present invention shall be explained in greater detail in the following with reference to the accompanying drawings, in which:

FIG. 1 a schematic illustration of an apparatus for notching according to an embodiment;

FIG. 2 a sectional view of an apparatus for notching according to an embodiment;

FIG. 3 a schematic illustration of a drive device for an apparatus for notching according to an embodiment;

FIG. 4 an illustration of a frame of an apparatus for notching according to an embodiment;

FIG. 5 a schematic illustration of a direct drive according to an embodiment;

FIG. 6 temporal courses of a motion of the plunger and of the workpiece according to an embodiment;

FIG. 7 temporal courses of a motion of the plunger and of the workpiece according to an embodiment;

FIG. 8 a schematic illustration of different strokes of the plunger according to an embodiment;

FIG. 9 a flowchart of a method for driving an apparatus for notching according to an embodiment;

FIG. 10 a schematic illustration of a tool cartridge according to an embodiment;

FIG. 11 a schematic illustration of a tool cartridge according to an embodiment;

FIG. 12 a machined workpiece according to an embodiment; and

Figure 13:
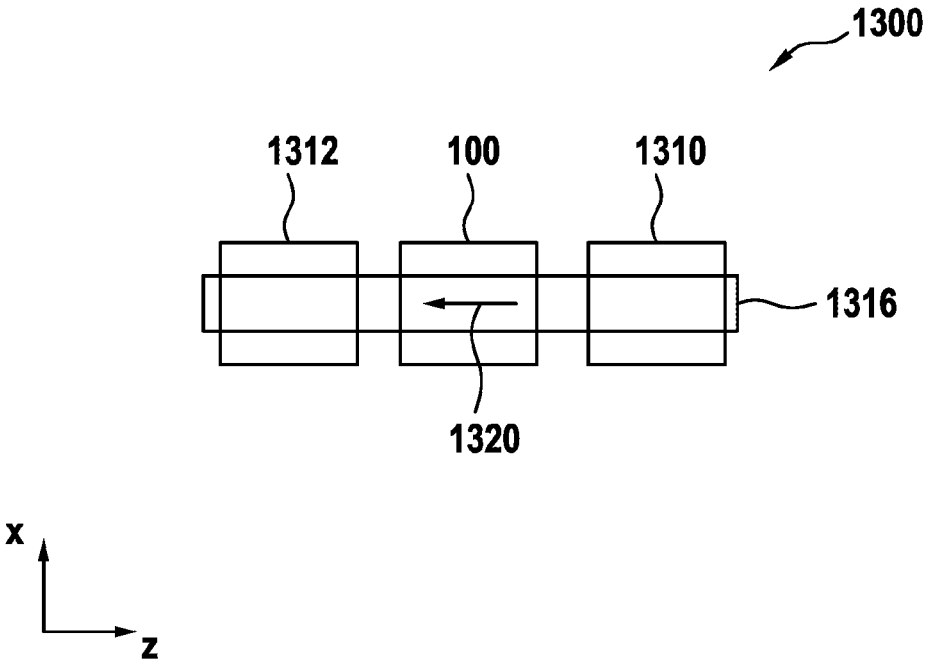

FIG. 13 a schematic illustration of a punching system according to an embodiment.

In the subsequent description of preferred embodiments of the present invention, the same or similar reference numerals shall be used for the elements illustrated in the various drawings and having similar effect, wherein repeated description of these elements shall be omitted.

FIG. 1 shows a schematic illustration of an apparatus 100 for notching according to an embodiment. The apparatus 100 is used to machine a workpiece 102. The apparatus 100 comprises a frame including at least a first stand 104, a headpiece 106 and a second stand 108. Optionally, the frame includes a table frame 110. In the assembled state of the apparatus 100, for example, the frame is mounted to the ground 112 of a production hall. The frame may be formed in one piece or as several pieces. Thus, the stands 104, 108, the headpiece 106 and the optional table frame 110 may, for example, represent separate components connected to form the frame or only representing portions of the frame, which may also be formed as a mono block, for example.

According to an embodiment, the stands 104, 108 have a main direction of extension along a y axis, and the headpiece 106 has a main direction of extension along an x axis of an orthogonal coordinate system. The headpiece 106 spans a gap between the stands 104, 108, which are arranged offset from each other along the x axis according to this embodiment. The frame thus forms a gateway, or a window together with the table frame 110, enclosing a workspace. A main plane of extension of the workspace, also referred to as workspace plane, extends in parallel to the x-y plane. Thus, the workspace is limited laterally by the stands 104, 108, upwardly by the headpiece 106 and downwardly by the ground 112 or the table frame 110.

As an alternative to the oaf frame shown in FIG. 1, the apparatus 100 may comprise a C frame with only one stand 104 and the headpiece 106.

The apparatus 100 includes a plunger 114 which can be moved back and forth, here the up and down, along a punching axis 116. The plunger 114 is coupled to the headpiece 106. The plunger 114 is driven by a drive device including a direct drive 118. According to an embodiment, the direct drive 118 is arranged on the headpiece 106.

The apparatus 100 optionally comprises an indexing head 120. The indexing head 120 is connected to the frame or to the ground 112, for example. For example, the indexing head 120 is supported by the stands 104, 106 or the table frame 110. The indexing head 120 is configured to pick up the workpiece to be machined and hold it during a punching process. Furthermore, the indexing head 120 is configured to rotate the workpiece 102 about an indexing head axis 122. To this end, the indexing head 120 exemplarily comprises suitable rotation means 123, for example in the form of an electric motor. The indexing head axis 122 is oriented along the y axis and offset from the punching axis 116. According to this embodiment, the indexing head axis 122 and the punching axis 116 are offset along the z axis. In the case of a C frame, the indexing head axis 122 and the punching axis 116 would be offset along the x axis.

According to an embodiment, the apparatus 100 comprises means 124 for moving the workpiece 102 or of the entire indexing head 120. In this way, a distance between the indexing head axis 122 and the punching axis 116 may be changed. According to an embodiment, the means 124 or other means is configured to additionally or alternatively move the workpiece 102 or the entire indexing head 120 along the x axis.

According to an embodiment, an upper tool part is arranged on the end of the plunger 114 facing the table frame 110, and a lower tool part is arranged on a side of the workpiece 102 facing away from the plunger 114. For example, the lower tool part is arranged on a table plate of the apparatus 100 coupled to the frame. The tool parts may be tool parts as they are already used in known notching presses. The upper tool part may form a tool cartridge together with the lower tool part. A notch in the workpiece 102 can be produced using the upper tool part and the lower tool part through movement of the plunger 114 along the punching axis 116 in the direction of the table frame 110. To this end, the plunger may perform a punching stroke.

According to an embodiment, the direct drive 118 comprises a drive shaft coupled to the plunger 114 via a connecting rod. The direct drive 118 is configured to effect the punching stroke of the plunger 114 by rotating the drive shaft. According to an embodiment, the drive shaft is rotated only about a portion of a full revolution. The plunger 114 is moved between a top reversal point and a bottom reversal point by the punching stroke.

According to an embodiment, in a so-called upstroke, the plunger 114 may be moved so far to a top reversal point that continuous gap through which the workpiece, which is the unmachined workpiece and/or the machined workpiece, and particularly also a center of the workpiece can be moved forms between the upper tool part and the lower tool part. Thus, the gap may extend along a plane extending transversely to the y axis. To this end, the upper tool part at the lower tool part are arranged to be spaced from each other without overlap. Without overlap can be understood to mean that the tool parts may be moved relative to each other along the z axis and along the x axis without the tool parts coming into contact with each other. When the plunger 114 is at the top reversal point, an end of the upper tool part facing away from the headpiece 106 is arranged more closely to the headpiece 106 than an end of the lower tool part facing the headpiece 106.

According to an embodiment, the direct drive 118 is configured to effect the upstroke of the plunger 114 also by rotating the drive shaft.

According to an embodiment, the apparatus 100 comprises a controller 126. The controller 126 is configured to provide an electric control signal for controlling the direct drive 118. According to an embodiment, the controller 126 further is configured to provide a further control signal for controlling the means for rotating 123. This allows for coordinating the movements of the plunger and of the workpiece. The controller 126 may be arranged on the frame, the direct drive 118 or also external to the apparatus 100.

According to an embodiment, the apparatus 100 is realized as a machine which may either be a manual loading machine or a machine. In manual loading machines, the workpieces 102, here for example sheets 102, are manually loaded and removed again.

In the case of an automated machine concept, due to the drive device realized with the direct drive 118, the apparatus 100 does not require an additional upstroke axis to make enough room for loading and removing the sheets through the automation.

Advantageously, the apparatus 100 realized as a notching press does not have a fixed stroke due to the direct drive. Thus, the stroke of the plunger 114 may be flexibly adapted to the production process. A flywheel for the drive device 118 also is not required, so that the apparatus does not have to run in continuous operation and can be regulated and programmed temporally, e.g. from notch to notch. For inserting and removing the sheets, the apparatus 100 does not need an additional axis, which would skew an additional eccentric, in order to generate the upstroke. Hence, the control is very simple to realize despite the cycle times. The indexing head axis 122, which rotates the workpiece corresponding to the desired notching, does not have to follow the main axis, here the notching axis 116. Thus, no rotation sensor on the main axis is required for coupling the two axes, and the arising vibrations, also by the vibration of the machine, do not have to be filtered elaborately. Advantageously, the indexing head axis 122 does not limit the speed of the overall process. Instead, the freedom of movement of the tool and the flexible plunger stroke can be used to optimize the speed of the overall process. Due to the direct drive, the plunger motion no longer is limited to an unswayable sinusoidal course, i.e. e.g. for intermittent punching it is no longer necessary for the indexing head axis 122 to cope a very high dynamics, because a greater angular step has to be moved in the same time interval. Since the press does not necessarily have two make a complete stroke, the impact velocity of the plunger onto the tool can be kept small and has a positive effect on the service life of the tool. Coupling and brake as well as the mechanical drive train are prone to wear. For maintenance, it is not necessary to disassemble a complete drive train located in the housing of the machine. The so-called two-position punching, in which additional notches or marks are introduced and a second punching plane, is possible with only little effort regarding the punching tool or the drive mechanics. The possible number of strokes here is very high.

According to an embodiment, the drive device realized as direct drive 118 represents the main drive of the apparatus 100 in form of a direct drive, for example with a torque motor. The direct drive 118 comprises optional dynamic balancing of masses and optional water cooling.

FIG. 2 shows a sectional view of an apparatus 104 notching according to an embodiment. It may be a section through the apparatus described on the basis of FIG. 1 along a sectional plane extending in parallel to the x-z plane.

What is shown of the apparatus 100 is a section through the first stand 104 and the second stand 108 as well as a top view onto the table frame 110. Moreover, an upper tool frame of an upper tool part 230 of the apparatus 100 is shown. The upper tool part 230 is movable along the punching axis 116 described on the basis of FIG. 1. The upper tool part 230 exemplarily comprises two through-holes serving as tool guides 232.

The workpiece 102, also referred to as sheet 102 in the following, is shown at two positions. The unmachined workpiece 102, which is supplied to the apparatus 100 by means of a first movement 234 and is placed on the indexing head of the apparatus 100 described on the basis of FIG. 1, for example, is shown at the position illustrated the top in FIG. 1. The first movement 234 corresponds to a loading of the apparatus 100. Correspondingly, the workpiece 102 is shown at a second position illustrated at the bottom FIG. 1. At the second position, the workpiece 102 may be machined. Following machining, the machined workpiece is moved away from the apparatus 100 by means of a second movement 236. The second movement 236 corresponds to an unloading of the apparatus 100.

The first movement 234 and the second movement 236 are in alignment with each other. The movements 234, 236 extend along a movement axis extending along the z axis. Thus, the workpiece 102 is guided completely through the workspace opened up by the frame of the apparatus 100. In particular, a center 238 of the workpiece 102 is guided through between the first stand 104 and the second stand 108. As can be seen from FIG. 2, the movement axis is oriented orthogonally with respect to a main direction of extension of the table frame 110 and thus of the headpiece.

A hatched area of the workpiece 102 shown at the second position represents a region in which there is space for a sucker or grabber when removing the workpiece 102. Since the workpiece 102 is removed parallel to the z axis, the region also extends into a section between the upper tool part 230 and the stands 104, 106.

The workpiece 102 is exemplarily shown as a round sheet 102. Alternatively, a differently shaped, for example rectangular blank 240 may be machined correspondingly.

FIG. 3 shows a schematic illustration of a drive device for an apparatus for notching according to an embodiment. The drive device comprises the direct drive 118 for driving the plunger of the apparatus, the means for rotating 123 for rotating a workpiece arranged on the indexing head and a controller 126.

The controller 126 is configured to provide electric control signal 318 for controlling the direct drive. The control signal 318 is suited to control rotation of a drive shaft of the direct drive 118. For example, the control signal 318 is configured to control a rotational speed, a rotation direction and a rotation angle of the drive shaft.

According to an embodiment, the controller 126 is configured to provide the control signal 318 with a first signal characteristic by which rotation of the drive shaft about a first portion of a full revolution of the drive shaft in a first rotational direction starting from a first reference position is effected. By the rotation about the first portion, the drive shaft is rotated to a second reference position. The first reference position and the second reference position may correspond to a first angular position and to a second angular position of the drive shaft, respectively. The first portion may correspond to a first rotation angle about which the drive shaft is rotated, in order to be rotated to the second angular position starting from the first angular position. By the rotation, the plunger coupled to the drive shaft can be moved from a top reversal point via a lowest reversal point back to the top reversal point.

According to an embodiment, the controller 126 is configured to provide to the control signal with a second signal characteristic by which rotation of the drive shaft about the first portion of the full revolution of the drive shaft opposite to the first rotational direction starting from the second reference position is effected. By the rotation about the first portion, the drive shaft is rotated backward to the first reference position. By rotating backward, the plunger can be moved from the top reversal point via the lowest reversal point back to the top reversal point.

According to an embodiment, the controller 126 is configured to provide the control signal 318 with a first signal characteristic by which rotation of the drive shaft about a second portion of a full revolution of the drive shaft in the first rotational direction starting from the first reference position or a further reference position is effected, for example. By the rotation about the second portion, the drive shaft is rotated to a third reference position. The third reference position may correspond to a third angular position of the drive shaft and to a further bottom reversal point of the plunger.

According to an embodiment, the controller 126 is configured to provide the control signal with a fourth signal characteristic by which rotation of the drive shaft about the second portion of the full revolution of the drive shaft opposite to the first rotational direction starting from the third reference position is effected. By the rotation about the second portion, the drive shaft is rotated backward to the first reference position or the further reference position. Thus, a further punching plane of the tool of the apparatus can be used. Thereby, two-position punching can be realized.

According to an embodiment, the controller 126 is configured to provide the control signal 318 with a fifth signal characteristic by which rotation of the drive shaft to a rest position is effected. The rest position may correspond to a topmost reversal point of the plunger. Thus, by rotating the drive shaft to the rest position, an upstroke can be realized.

For example, the signal characteristics may differ with respect to an analog waveform, for example the signal amplitude, the signal frequency or the impulse duration, and/or with respect to digital data to be transmitted. The control signal 318 may have different signal characteristics at different time instants. Different control signals may be employed as an alternative to a control signal capable of taking on different signal characteristics.

The control signal 318 may be used to move the plunger in a manner that is as optimal as possible for the operation of the apparatus between a topmost and a bottom level that can be reached maximally. In particular, using the control signal 318, the direct drive 118 may be controlled so that pendular operation of the plunger is carried out by rotating the drive shaft back and forth.

According to an embodiment, the controller 126 is configured to provide an electric driving signal 323 for controlling the means for rotating 123 for rotating the workpiece arranged on the indexing head. Advantageously, the controller 126 is configured to coordinate the driving signal 323 and the control signal 318 with respect to each other. For example, this allows for setting the rotational speed of the drive shaft depending on a current course of a rotation of the workpiece about the indexing head axis.

FIG. 4 shows an illustration of a frame of an apparatus for notching according to an embodiment. It may be an embodiment of the frame described on the basis of FIG. 1. The frame represents a machine frame realized as an O frame.

The frame comprises the first stand 104, the headpiece 106, the second stand 108 and the table frame 110. On a side of the table frame 110 facing the headpiece 106, there are arranged two rails 450 for guiding the indexing head and a table plate 452 for the lower tool. A direct drive, such as shown in FIG. 5, for example, may be arranged between the parallel vertical walls of the headpiece 106.

FIG. 5 shows a schematic illustration of a direct drive 118 for an apparatus for notching according to an embodiment. It may be a direct drive 118 of a drive device mentioned on the basis of FIG. 1.

The direct drive 118 includes an electric motor 560 having a rotor 562 and a stator 564 and a drive shaft 566 drivable by the electric motor 560, also referred to as an eccentric shaft. According to an embodiment, the drive shaft 566 is the shaft of the electric motor 560 connected to the rotor 562. Thus, a rotational speed of the electric motor 560 may correspond to a rotational speed of the drive shaft 566. The drive shaft 566 carries an eccentric 568. The eccentric 568 is coupled to a connecting rod 570 via a bearing 572 for the connecting rod 570. The connecting rod 570 is coupled to the plunger shown in FIG. 1, for example, in the operational state of the apparatus.

Optionally, the drive device comprises a housing 574, and the drive shaft 566 is supported on the housing 574 via a bearing 576 of the housing 574. For example, the housing 574 encloses the electric motor 560.

The direct drive 118 may be arranged on the headpiece of the apparatus shown in FIG. 1 or integrated into the headpiece.

According to an embodiment, the drive device represents a main drive of the apparatus and is realized as the direct drive 118 with the electric motor 560 in form of a torque motor. Here, dynamic balancing passes and/or water cooling may be provided.

Due to the direct drive 118 and a corresponding design of the drive, at a very high stroke rate, the main drive may be operated in pendular operation.

The plunger stroke may be adjusted freely, and thereby both the freedom of movement of the tool and the interaction between main drive and indexing head may be programmed and optimized depending on the process.

For example, if the speed of the indexing head is the limiting factor, the main drive may operate at higher dynamics in shorter time so as to give the indexing head more time. This optimization may also be applied vice versa. Due to the pendular motion and the lower plunger stroke, the impact velocity may be reduced significantly, which is very advantageous for the service life of the tools.

Advantageously, no additional axis is needed for the upstroke, which can be realized simply by suitable positioning, i.e. by stopping at the top dead center.

The direct drive 118 in form of a drive unit optionally is mounted in the separate housing 574 and may be dismounted very easily from the basic frame of the apparatus for purposes of maintenance or replacement.

Another advantage in connection with the O frame and a concept of automation in which the workpiece is moved through the apparatus consists in the fact that during the pendular motion correspondingly constructed guides of the tool may remain engaged and are separated from each other only during the upstroke, so that enough space for feeding the workpiece through the apparatus is obtained.

According to an embodiment, the main drive and the indexing head axis share an electronic guiding wave. Toward the end of the punching process for producing a stator and a rotor, when rotor and stator additionally are separated from each other during punching, the sheet becomes unstable, because the transport of the indexing head is via the center bore of the rotor.

According to an embodiment, the regulation of the guiding wave is used to reduce and exactly regulate the number of strokes and thus the dynamics, so that the accuracy of the sheet remains ensured.

The optimization of indexing head and main drive as already described also is helpful for this process.

Advantageously, two-position punching can be performed with the direct drive 180 without taking further measures. In this case, two dies at different heights are installed in the tool.

Using the positioning-regulated direct drive 118, the plunger can be moved so that only one die immerses and then is reversed prior to the impact of the second die. In a next stroke, for example, movement may be via the previous bottom reversal point. This process is freely programmable in turn for each notch.

No additional axis is needed for the upstroke, but it can be realized simply by positioning the plunger or by stopping at the top dead center.

According to an embodiment, the drive device realized as a drive unit is mounted in the separate housing 574 and may be disassembled from the basic frame of the punch press very easily for purposes of maintenance or replacement.

Furthermore, according to an embodiment, the direct drive 118 has a balancing of masses integrated on the drive shaft, which balances the accelerations of the plunger including the tool weight. The avoidance of vibrations contributes to the running smoothness and to the extension of the life of all machine elements.

In manual loading operation, it is conceivable to omit a protective grid, because in a pendular motion the working stroke is reduced correspondingly so that according to the DIN standard there is no more crushing hazard. Economics and cycle time when loading and offloading then is improved significantly for manual loading operations.

Furthermore, the main drive as direct drive 118 has very few components and also offers a very rigid drive due to the small constructive space, which has a very positive effect on the life.

According to an embodiment, the main drive is liquid cooled and, according to an embodiment, supported by means of a rolling bearing. Thus, thermal influence in form of linear expansion, which otherwise could have a negative influence on the production process taking place in the "range of one hundredth", is avoided.

FIG. 6 shows temporal courses 616, 622 of a motion of the plunger and of the workpiece according to an embodiment. Those may be a course 616 of the motion of the plunger along the punching axis shown in FIG. 1 and a course 622 of the rotation of the workpiece about the indexing head axis shown in FIG. 1.

The time t is plotted on the abscissa, and a distance s with respect to the course 616 of the motion of the plunger and an angular position a with respect to the course 622 of the rotation of the workpiece are plotted on the ordinate.

The course 616 corresponds to a rotation of the drive shaft, for example of the direct drive shown in FIG. 5, at constant rotational speed and at variable rotational speed, for example.

The level s0 corresponds to a bottom reversal point of the plunger, the level s1 corresponds to a bottom side of the workpiece, the level s2 corresponds to a top side of the workpiece, the level s3 corresponds to a level of a holding-down device for the workpiece, and the level s4 corresponds to a top reversal point of the plunger. The distance between s1 and s2 thus corresponds to a sheet thickness of the workpiece. The distance between s0 and s4 corresponds to a punching stroke of the plunger.

At the time instant t0, the drive shaft is at an angular position corresponding to the top reversal point of the plunger. The time instants t1 and t3 characterize impact points of the holding-down device on the workpiece. The time interval is between the time instants t1 and t3 corresponds to a punching process. The bottom reversal point is reached at the time instant t2, and to the top reversal point of the plunger is reached again at the time instant t4.

According to an embodiment, the drive shaft is rotated about a portion of a full revolution of the drive shaft in a first rotation direction between the time instants t0 and t4. For performing a further punching stroke, the drive shaft then is rotated backward by the first portion opposite to the first rotation direction to the time instant t4.

According to an alternative embodiment, the drive shaft is rotated by a portion of a full revolution of the drive shaft in a first rotation direction between the time instants t0 and t2 and is rotated backward by the portion opposite to the first rotation direction between the time instants t2 and t4.

The time instant t5 and the time instant t6 characterize an endpoint of the indexing head and a starting point of the indexing head, respectively. Between the time instants t5 and t6, the workpiece cannot be rotated because of the punching process.

According to an alternative embodiment, the drive shaft performs a full revolution in the first rotation direction between the time instants t0 and t4. For performing a further punching stroke, the driveshaft then is rotated further by another full revolution in the first rotation direction to the time instant t4.

According to an alternative embodiment, the drive shaft is rotated at a lower rotational speed between the time instants t1 and t3 than between the time instants t0 and t1 and/or the time instants t3 and t4, for example. In this way, the time ts can be increased.

FIG. 7 shows temporal courses 616, 622 of the motion of the plunger and of the workpiece according to an embodiment, corresponding to FIG. 6. Differing from the embodiment shown in FIG. 6, optimization of the drive of the indexing head has been performed. The drive shaft is stopped in the angular position corresponding to the top reversal point and then moved at increased speed to perform the punching process. Due to the increased speed, the plunger reaches the top reversal point at a time instant t4 that is early as compared with FIG. 6. Moreover, the time ts of the punching process is reduced significantly. Thereby, the available time tTA for the indexing head axis is increased significantly.

It can be seen from the FIGS. 6 and 7 that high flexibility with respect to the drive optimization both of the main drive and of the indexing head becomes possible by varying the rotational speed and rotation direction of the drive shaft.

FIG. 8 shows a schematic illustration of different strokes 801, 803, 805 of the plunger according to an embodiment.

For example, there is shown an upstroke 801, in which the plunger is moved between a topmost reversal point and a lowermost reversal point.

Furthermore, there is shown a punching stroke 803, which the plunger is moved between a top reversal point and the lowermost reversal point.

Furthermore, there is shown a further punching stroke 805, in which the plunger is moved between the top reversal point and a bottom reversal point. If the punching stroke 803 and the further punching stroke 805 I used for machining a workpiece, two punching planes of a tool can be utilized.

FIG. 9 shows a flowchart of a method for driving an apparatus for notching according to an embodiment. It may be an apparatus as is described on the basis of FIG. 1.

The method includes a step 901, in which a drive shaft of the direct drive of the apparatus is rotated so as to move the plunger. By rotating a punching stroke or an upstroke can be performed, for example. The step 901 may be repeated multiple times, wherein a rotation angle of the rotation of the drive shaft may be varied, for example.

According to an embodiment, the step hundred one includes a step 903, in which the driveshaft is rotated in one rotation direction, and additionally or alternatively a step 905, in which the drive shaft is rotated in the opposite rotation direction. Thus, pendular operation may be performed.

Optionally, the method includes a step 907, by which rotation of the workpiece about the indexing head axis is effected. For example, a step 907 is performed between two successive steps 901 so that the workpiece is rotated between two punching processes.

Optionally, the method includes a step 909, by which a distance between the indexing head axis and the punching axis is changed. To this end, for example, a suitable electric moving signal may be provided to the means for moving shown in FIG. 1.

At least some of the steps 901, 903, 905, 907, 909 may be repeated multiple times in a suitable and also changing order for machining a workpiece. Control of the steps may take place using the controller described on the basis of FIG. 3, for example.

According to an embodiment, the step 903 is executed to move the plunger from a top reversal point via a bottommost reversal point back to the top reversal point, for example. Then, the step 905 is executed to move the plunger from the top reversal point via the bottommost reversal point back to the top reversal point. Then, the step 907 and after that again the steps 903, 905 may be executed.

According to an embodiment, the step 903 is executed to move the plunger from a top reversal point to a bottom reversal point. Then, the step 905 is executed to move the plunger 114 from the bottom reversal point back to the top reversal point. Then, the step 907 and after that again the steps 903, 905 may be executed.

FIG. 10 shows a schematic illustration of a tool cartridge for an apparatus for notching according to an embodiment. The tool cartridge includes an upper tool part 230 and a lower tool part 1030. In the assembled state, for example, the upper tool part 230 is attached to the free end of the plunger shown in FIG. 1, and the lower tool part 1030 is attached to the table plate shown in FIG. 4.

The upper tool part 230 includes at least one, here exemplarily two upper guiding elements 1032. The lower tool part 1030 includes at least one, here exemplarily two lower guiding elements 1034. The upper guiding elements 1032 and the lower guiding elements 1034 each comprise guiding faces along which the mutually corresponding guiding elements 1032, 1034 may slide along each other when the upper tool part 230 is moved along the punching axis 116.

During a punching process, the upper tool part 230 performs a punching stroke, for example in form of a pendular stroke if using a direct drive. The lengths of the guiding faces with respect to the direction of the punching axis 116 are chosen so that a guiding length 1036 at least corresponds to the maximum punching stroke. In this way, the parts are guided safely by the guiding elements 1032, 1034 during the punching process.

According to an embodiment, the guiding elements 1032, 1034 are removably connected to the tool parts 230, 1030 and may be removed following the installation of the tool cartridge in the apparatus for notching. This facilitates moving the workpiece through between the tool parts 230, 1030.

FIG. 11 shows a schematic illustration of the tool cartridge described on the basis of FIG. 10 for apparatus for notching according to an embodiment.

The tool cartridge is shown in an upstroke, in which the upper tool part 230 has been moved further away from the lower tool part 1030 along the punching axis 116 than in a punching process, in order to enable supplying or removing a workpiece 102.

The upper guiding faces 1132 of the upper guiding elements 1032 and the lower guiding faces 1134 of the lower guiding elements 1034 are provided with reference numerals in FIG. 11.

During the upstroke, the upper tool part 230 may have a maximum stroke 1136. Thus, the tool cartridge may be maximally open.

According to an embodiment, the plunger is moved so far to a top reversal point, for example the top dead center, that the guiding elements 1032, 1034 no longer overlap and a continuous gap greater than a thickness of the workpiece 102 is formed between the tool parts 230, 1030. When the workpiece is guided through between the tool parts 230, 1030, the upper tool part 230 is completely above the workpiece 102 and the lower tool part 1030 is completely below the same.

If a direct drive is employed for driving the plunger, due to pendular motion, movement during the punching can be only in the lower region of the guiding elements 1032, 1034 shaped as guides, which is where the suitably constructed guiding elements 1032, 1034 always remain immersed and ensure the necessary guidance for the small cutting clearances. Following completion of the punching process, according to an embodiment, the plunger is moved to the top dead center, which corresponds to the upstroke. Thereby, the guiding elements 1032, 1034 are moved apart so that the apparatus can be loaded from behind passing above and below the separated guiding elements 1032, 1034 when using an O frame.

FIG. 12 shows a machined workpiece 1202 according to an embodiment, produced from an unmachined workpiece using the apparatus described on the basis of FIG. 1, for example. The workpiece 1202 is a circular sheet into which through-holes have been punched. The through-holes here are arranged along an outer ring and optionally along inner ring. According to this embodiment, the through-holes along the inner ring only serve as air holes. According to an embodiment, the workpiece 1202 is a sheet produced by means of intermittent punching.

FIG. 13 shows a schematic illustration of a punching system 1300 according to an embodiment. The punching system 1300 includes a provider 1310 for providing an unmachined workpiece, an apparatus 100 for notching and a repository 1312 for depositing a workpiece machined by the apparatus 100, as shown in FIG. 12, for example. The provider 1310, the apparatus 100 for notching and the repository 1312 are arranged in a row. The apparatus 100 is arranged between the provider 1310 and the repository 1312. A moving unit 1316 is configured to move the workpiece along a movement axis 1320 from the provider 1310 to the apparatus 100 and from the apparatus 100 to the repository 1312 in unidirectional movements.

Such an arrangement may advantageously be realized using an apparatus 100 comprising an O frame, as described on the basis of FIG. 1. Such a realization is facilitated by the direct drive described, by which a sufficiently great upstroke by which the tool utilized can be moved apart completely can be realized in a simple way, so that a workpiece can be moved through between the upper tool part and the lower tool part by the moving unit 1316.

The invention claimed is:

1. Apparatus for notching, comprising:

a frame with a stand and a headpiece;

a plunger coupled to the headpiece and movable along a punching axis oriented along a y axis;

an electrical direct drive for driving the plunger, wherein the direct drive comprises an electric machine with a drive shaft, wherein the drive shaft carries an eccentric, wherein the eccentric is coupled to a connecting rod via a bearing for the connecting rod, and wherein the connecting rod is coupled to the plunger; and a controller configured to provide an electric control signal for effecting rotation of the drive shaft of the direct drive, in order to effect linear motion of the plunger, characterized in that the rotation of the drive shaft comprises, for realizing a pendular operation of the plunger, a step of rotating forward the drive shaft and a step of rotating backward the drive shaft, wherein when rotating forward and when rotating backward, a punching stroke for punching a notch each is performed, wherein in the step of rotating forward, the drive shaft is rotated about a first portion of a full revolution in a first rotational direction to move the plunger from a top reversal point via a lowest reversal point back to the top reversal point, wherein in the step of rotating backward, the drive shaft is rotated about the first portion in a second rotational direction opposite to the first rotational direction to move the plunger from the top reversal point via the lowest reversal point back to the top reversal point, wherein in rotation of the draft shaft, following completion of a punching process, the drive shaft is rotated to a predetermined rest position starting from a current position, in order to effect an upstroke of the plunger, in order to enable supplying or removing a workpiece to be machined.

2. Apparatus for notching according to claim 1, comprising an indexing head for accommodating the workpiece to be machined, wherein the indexing head is coupled to the frame and configured to rotate the workpiece about an indexing head axis oriented along the y axis, and wherein the frame comprises a second stand arranged offset from the stand along an x axis, wherein the headpiece connects the stand and the second stand to each other, and wherein the indexing head axis and the punching axis are offset from each other along a z axis.

3. Apparatus for notching according to claim 1, wherein the electric machine of the electrical direct drive is arranged on the headpiece.

4. Method for driving an apparatus for notching, wherein the apparatus comprises a frame with a stand and a headpiece, a plunger coupled to the headpiece and movable along a punching axis oriented along a y axis, and an electrical direct drive for driving the plunger, wherein the direct drive comprises an electric machine, a drive shaft drivable by the electric machine and carrying an eccentric and a connecting rod coupled to the eccentric and coupleable to the plunger, the method comprises the step of:

rotating the drive shaft of the direct drive of the apparatus to effect linear motion of the plunger, characterized in that the step of rotating comprises, for realizing a pendular operation of the plunger, a step of rotating forward the drive shaft and a step of rotating backward the drive shaft, wherein when rotating forward and when rotating backward, a punching stroke for punching a notch each is performed, wherein in the step of rotating forward, the drive shaft is rotated about a first portion of a full revolution in a first rotational direction to move the plunger from a top reversal point via a lowest reversal point back to the top reversal point, wherein in the step of rotating backward, the drive shaft is rotated about the first portion in a second rotational direction opposite to the first rotational direction to move the plunger from the top reversal point via the lowest reversal point back to the top reversal point, wherein in the step of rotating, following completion of a punching process, the drive shaft is rotated to a predetermined rest position starting from a current position, in order to effect an upstroke of the plunger, in order to enable supplying or removing a workpiece.

5. Method according to claim 4, wherein in the step of rotating forward, the drive shaft is rotated about a second portion of the full revolution in the first rotational direction, and in the step of rotating backward, the drive shaft is rotated about the second portion in the second rotational direction.

6. Method according to claim 5, wherein in the step of rotating forward the drive shaft is rotated to move the plunger from the top reversal point to a bottom reversal point, and in the step of rotating backward the drive shaft is rotated backward to move the plunger from the bottom reversal point to the top reversal point.

7. Method according to claim 4, wherein in the step of rotating the drive shaft is rotated to the predetermined rest position starting from the current position, to move the plunger to a top dead center, which corresponds to the upstroke of the plunger.

8. Method according to claim 4, wherein in the step of rotating a rotational speed of the drive shaft is set depending on a course of a rotation of the workpiece about an indexing head axis.

9. Method according to claim 4, wherein in the step of rotating the drive shaft is rotated at a first rotational speed in a first time interval and at a second rotational speed different from the first rotational speed in a second time interval.

* * * * *